US009752546B2

(12) United States Patent
Hirabayashi

(10) Patent No.: US 9,752,546 B2
(45) Date of Patent: Sep. 5, 2017

(54) ENGINE STARTING APPARATUS

(71) Applicant: DENSO CORPORATION, Kariya, Aichi-pref. (JP)

(72) Inventor: Takashi Hirabayashi, Chita-gun (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/725,612

(22) Filed: May 29, 2015

(65) Prior Publication Data

US 2015/0354524 A1 Dec. 10, 2015

(30) Foreign Application Priority Data

Jun. 4, 2014 (JP) ..... 2014-115563

(51) Int. Cl.
*F02N 15/00* (2006.01)
*F02N 11/08* (2006.01)
(Continued)

(52) U.S. Cl.
CPC ..... *F02N 11/0851* (2013.01); *F02N 11/0859* (2013.01); *F02N 15/04* (2013.01); *F02N 15/046* (2013.01); *F02N 11/087* (2013.01); *F02N 11/0814* (2013.01); *F02N 15/023* (2013.01); *F02N 15/067* (2013.01);
(Continued)

(58) Field of Classification Search
CPC ..... F02N 11/0851; F02N 11/0859; F02N 11/087; F02N 11/0814; F02N 15/046; F02N 15/04; F02N 15/023; F02N 15/067; F02N 2015/061; F02N 2300/102; F02N 2300/2011; F02N 2300/104; F02N 2300/2002
See application file for complete search history.

(56) References Cited

U.S. PATENT DOCUMENTS 7,913,548 B2 * 3/2011 Ono ..... F02D 41/0097 73/114.25
2004/0123587 A1 * 7/2004 Kamiya ..... F02D 41/0235 60/284

(Continued)

FOREIGN PATENT DOCUMENTS

JP 2004-197719 A 7/2004

*Primary Examiner* — Hieu T Vo
*Assistant Examiner* — Sherman Manley
(74) *Attorney, Agent, or Firm* — Oliff PLC

(57) ABSTRACT

An apparatus for starting an engine, including an inertia-engagement-type starter. In the apparatus, a starter-characteristic switching mechanism is configured to switch an output characteristic of the starter between a plurality of output characteristics including at least a low-torque high-speed characteristic and a high-torque low-speed characteristic, where the output characteristic of the starter is hereinafter referred to a starter characteristic. A timing controller is configured to control when the starter-characteristic switching mechanism switches the starter characteristic such that the starter characteristic is set to the high-torque low-speed characteristic from initiation of actuation of the starter at least until a pinion successfully meshes with a ring gear, and after the pinion has successfully meshed with the ring gear, the starter characteristic is switched from the high-torque low-speed characteristic to the low-torque high-speed characteristic at which the engine is cranked by the starter.

6 Claims, 2 Drawing Sheets

(51) Int. Cl.
*F02N 15/04* (2006.01)
*F02N 15/02* (2006.01)
*F02N 15/06* (2006.01)

(52) U.S. Cl.
CPC .. *F02N 2015/061* (2013.01); *F02N 2300/102* (2013.01); *F02N 2300/104* (2013.01); *F02N 2300/2002* (2013.01); *F02N 2300/2011* (2013.01)

(56) References Cited

U.S. PATENT DOCUMENTS

2010/0125019 A1* 5/2010 Tabata ..... B60K 6/365 477/3
2010/0282200 A1* 11/2010 Notani ..... F02N 11/0844 123/179.3
2013/0289855 A1* 10/2013 Kitano ..... F02N 11/00 701/113
2013/0296126 A1* 11/2013 Gibson ..... F02N 11/006 477/5
2015/0314777 A1* 11/2015 Koike ..... B60K 6/442 701/22

* cited by examiner

ENGINE STARTING APPARATUS

CROSS-REFERENCE TO RELATED APPLICATION

This application is based on and claims the benefit of priority from earlier Japanese Patent Applications No. 2014-115563 filed Jun. 4, 2014, the descriptions of which are incorporated herein by reference.

BACKGROUND

Technical Field

The present invention relates to an engine starting apparatus capable of switching an output characteristic of a starter between a low-torque high-speed characteristic and a high-torque low-speed characteristic.

Related Art

Conventionally, there is a desire for an idle-stop-enabled starter to reduce an engine restarting time as much as possible to improve the comfort of a driver or other occupants of a vehicle. A technique for reducing the restarting time includes increasing a cranking speed. Such a technique, however, in combination with good start-up performance at low temperatures where engine friction is high, necessitates use of a large in size and high power motor.

A known technique for increasing the cranking speed at restarting of the engine without increasing dimensions of the motor includes switching as needed between high-speed and high-torque characteristics.

For example, Japanese Patent Application Laid-Open Publication No. 2004-197719 discloses preparing a motor including a series coil and a shunt coil as field coils and switching between the high-speed and high-torque characteristics by an electronic control unit (ECU) controlling field current flowing through the shunt coil of the motor.

The technique disclosed in Japanese patent application laid-open publication no. 2004-197719 can reduce an engine starting time from engine idle stop by setting an output characteristic of the starter at starting of an engine to a high-speed characteristic. At the high-speed characteristic of the starter, however, a rotational speed of a pinion may become too high for the pinion to reliably mesh with a ring gear, which may lead to diminished engagement reliability. A measure to overcome such a disadvantage may include increasing a load of a drive spring for pushing the pinion toward the ring gear at mesh.

Increasing the load of the drive spring, however, necessitates increasing an attraction force of a solenoid for attracting the pinion thereinto against a spring reaction force generated by the drive spring. This may lead to larger dimensions of the solenoid, thus leading to degradation of installation property of the starter and an increased starter cost.

In consideration of the foregoing, exemplary embodiments of the present invention are directed to providing an engine starting apparatus capable of reducing an engine starting time without increasing the size of the solenoid.

SUMMARY

In accordance with an exemplary embodiment of the present invention, there is provided an apparatus for starting an engine, including: an inertia-engagement-type starter configured to utilize an attractive force of a solenoid to push a pinion into an engaged position with a ring gear of the engine and then transfer a rotational force of the motor from the pinion to the ring gear to start the engine; a starter-characteristic switching mechanism configured to switch an output characteristic of the starter between a plurality of output characteristics including at least a low-torque high-speed characteristic and a high-torque low-speed characteristic, the output characteristic of the starter being referred to a starter characteristic; and a timing controller configured to control when the starter-characteristic switching mechanism switches the starter characteristic such that the starter characteristic is set to the high-torque low-speed characteristic from initiation of actuation of the starter at least until the pinion successfully meshes with the ring gear, and after the pinion has successfully meshed with the ring gear, the starter characteristic is switched from the high-torque low-speed characteristic to the low-torque high-speed characteristic at which the engine is cranked by the starter.

In the apparatus configured as above with the engine being cranked at the low-torque high-speed characteristic, the starter characteristic is set to the high-torque low-speed characteristic at least until the pinion successfully meshes with the ring gear. This can reduce the rotational speed of the pinion at mesh as compared to when the pinion meshes with the ring gear at the low-torque high-speed characteristic of the starter. More specifically, the pinion is pushed toward the ring gear by actuation of the solenoid and abuts the ring gear. When the pinion and the ring gear match in meshing phase during the rotation of the pinion, the pinion successfully meshes with the ring gear. The rotational speed of the pinion at mesh is a rotational speed of the pinion at the moment when the pinion successfully meshes with the ring gear. Such a rotational speed of the pinion at mesh is reduced, which can enhance engagement reliability.

In addition, there is no need to increase the load of a drive spring for pushing the pinion toward the ring gear, which can prevent dimensions of the solenoid from increasing. That is, this can reduce an engine starting time without increasing dimensions of the solenoid.

In addition, after the pinion has successfully meshed with the ring gear, the starter characteristic is switched to the low-torque high-speed characteristic at which the engine is cranked. This can reduce an elapsed time from the initiation of actuation of the starter until the engine start. Particularly, in the case of the vehicle with an idle stop system or an automated stop and go system, an elapsed time from the initiation of actuation of the starter until the engine restart can be reduced, which can contribute to enhancement of the comfort of a driver or other occupants of the vehicle.

DESCRIPTION OF SPECIFIC EMBODIMENTS

Some embodiments will now be described by way of example only and with reference to the accompanying drawings.

First Embodiment

Figure 1:
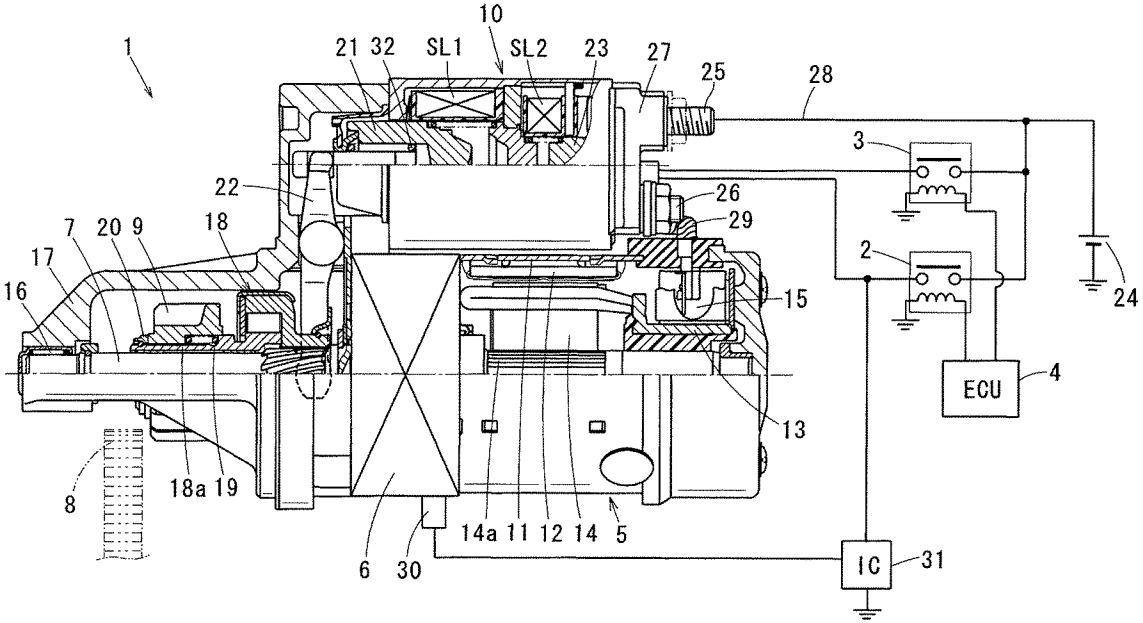
FIG. 1 is a schematic diagram of an engine starting apparatus in accordance with a first embodiment of the present invention.

An engine starting apparatus of a first embodiment is, as shown in FIG. 1, an inertia-engagement-type starter 1, a controller (hereinafter referred to as an electronic control unit (ECU)) 4 configured to control operations of the starter 1 via starter relays 2, 3, and a starter-characteristic switching mechanism (described later) configured to switch output characteristics of the starter 1 (hereinafter referred to as starter characteristics).

The starter 1 includes a motor 5 configured to generate a rotational force, an output shaft 7 to which the rotational force of the motor 5 is transferred via a variable reducer 6 (described later), a pinion 9 configured to transfer a drive torque of the motor 5 to a ring gear 8 of an engine, an electro-magnetic solenoid device 10 (described later), and other components.

The motor 5 is a brushed direct-current (DC) motor that includes a field element formed of permanent magnets arranged on an inner periphery of a yoke 11, an armature 14 having a commutator 13 disposed on an armature axis, brushes 15 configured to slide on the outer periphery of the commutator 13 as the armature 14 rotates, and other components. The field element may be a wound field type field element formed of field windings in place of the permanent magnets 12.

The output shaft 7 is arranged coaxially with an armature axis 14*a* through the variable reducer 6. An axial end portion of the output shaft 7 opposite the motor 5 is supported by a starter housing 17 via a bearing 16.

The pinion 9 is straight-splined to an outer periphery of an inner tube 18*a* of a clutch 18 and urged toward a distal end of the inner tube 18*a* (e.g., a left-hand-side end portion of the inner tube 18*a* in FIG. 1) by a pinion spring 19 to be in contact with a pinion stopper 20 attached at the distal end of the inner tube 18*a*.

The clutch 18 serves as a unidirectional clutch that is helical-splined to an outer periphery of the output shaft 7 to transfer the motor torque to the pinion 9, but interrupts torque transfer from the pinion 9 to the output shaft 7 when the pinion 9 is turned by the engine.

The electro-magnetic solenoid device 10 includes a solenoid SL1 for pushing the pinion 9 integrally together with the clutch 18 via a shift lever 22 in conjunction of movement of the plunger 21, and a solenoid SL2 for opening and closing main contacts in conjunction of movement of the plunger 23.

The main contacts include a pair of stationary contacts electrically connected via two terminal bolts 25, 26 to an energization path for supplying power from a battery 24 to the motor 5, and a movable contact for electrically opening and closing the pair of stationary contacts in conjunction of movement of the plunger 23.

The terminal bolts 25, 26 are secured to a resin cover 27 covering a proximal end portion of the electro-magnetic solenoid device 10 (e.g., a right-hand-side end portion of the electro-magnetic solenoid device 10 in FIG. 1). The terminal bolt 25 is electrically connected to a positive terminal of the battery 24 via a battery cable 28. The terminal bolt 26 is electrically connected to a positive brush 15 via a motor lead wire 29.

The starter-characteristic switching mechanism of the present embodiment will now be explained.

The starter-characteristic switching mechanism includes the variable reducer 6 and a mode switcher 30 configured to switch an operational mode of the variable reducer 6 between a retarding mode and a non-retarding mode.

The variable reducer 6 may include a well-known planetary reducer. In the retarding mode of the variable reducer 6, rotation of an internally-toothed gear (not shown) of the planetary reducer is restricted. In the non-retarding mode of the variable reducer 6, the rotation of the internally-toothed gear of the planetary reducer is unrestricted. The mode switcher 30 includes, for example a motor actuator (not shown), and is configured to switch the operational mode of the variable reducer 6 from the retarding mode to the non-retarding mode, or from the non-retarding mode to the retarding mode, in conjunction of the operation of the motor actuator.

In the retarding mode, the rotation of the internally-toothed gear is restricted. Therefore, the variable reducer 6 serves as a standard speed reducer. That is, the rotational speed of the motor 5 is reduced by the variable reducer 6 to be transmitted to the output shaft 7.

In the non-retarding mode, the rotation of the internally-toothed gear of the planetary reducer is unrestricted to be able to rotate in an unrestricted manner. Therefore, the variable reducer 6 does not serve as the speed reducer. That is, as the motor 5 rotates, constituent gears of the variable reducer 6 (e.g., the internally-toothed gear, the planetary gear, and a sun gear) rotate integrally together with each other. Therefore, the rotation of the motor 5 is transmitted to the output shaft 7 without being reduced by the variable reducer 6. That is, the starter characteristic is set to a high-torque low-speed characteristic by the variable reducer 6 setting the operation mode to the retarding mode, and set to a low-torque high-speed characteristic by the variable reducer 6 setting the operation mode to the non-retarding mode.

Operation of the starter 1, particularly, cranking of the engine at the low-torque high-speed characteristic when the engine is restarted from the engine idle stop, will now be explained.

The ECU 4 is configured to, upon receipt of an engine restart request, turn on the starter relay 2 and then the starter relay 3.

When the solenoid SL1 is activated by turning on the starter relay 2, the pinion 9 is pushed integrally together with the clutch 18 in the anti-motor direction (e.g., the right-to-left direction in FIG. 1) via the shift lever 22. When the pinion 9 and the ring gear 8 are out of meshing phase, axial end faces of teeth of the pinion 9 and axial end faces of teeth of the ring gear 8 abut each other.

Thereafter, when the solenoid SL2 is activated by turning on the starter relay 3, the main contacts are closed and the motor 5 is energized by the battery 24 to generate a rotational force. The rotational speed of the motor 5 is reduced by the variable reducer 6. The reduced rotation of the motor 5 is transmitted to the output shaft 7, and in turn transferred from the output shaft 7 to the pinion 9 via the clutch 18. When the pinion 9 and the ring gear 8 match in meshing phase during the rotation of the pinion 9, the teeth of the pinion are pushed into between respective pairs of adjacent teeth of the ring gear 8. The pinion 9 and the ring gear 8 thus successfully mesh with each other. Consequently, the motor torque is transferred from the pinion 9 to the ring gear 8 to crank the engine.

Figure 2:
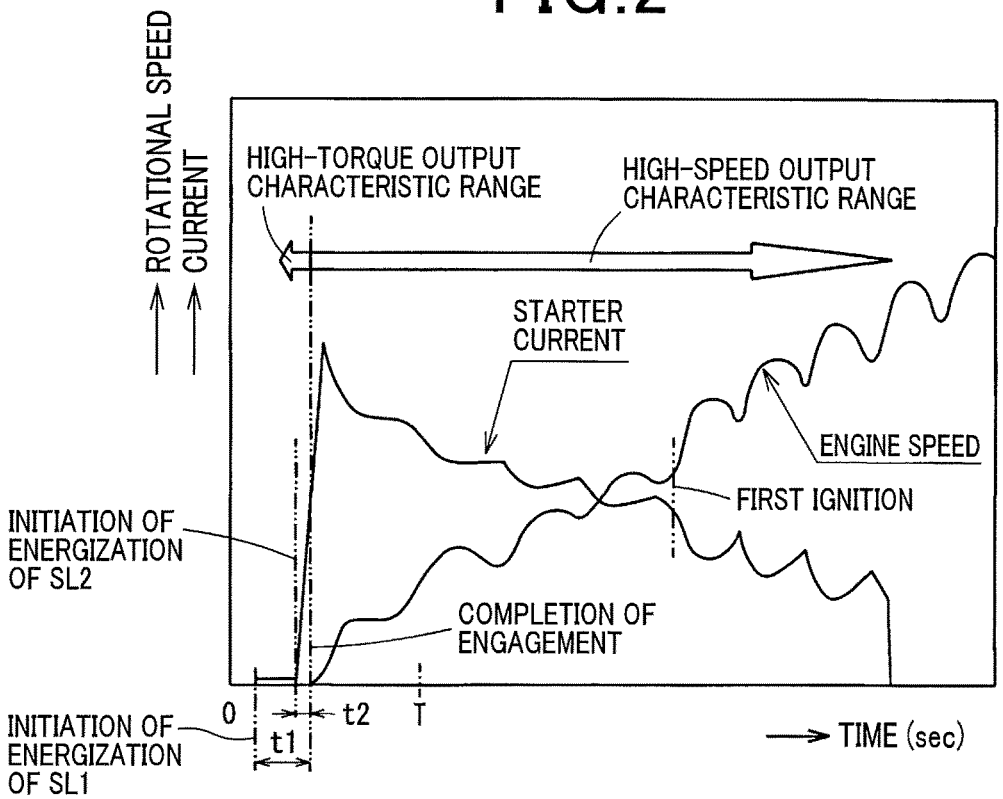
FIG. 2 is a waveform diagram illustrating time variations of a starter current and an engine speed at starting of an engine.

The variable reducer 6 is configured in the retarding mode from initiation of actuation of the starter 1 at least until the pinion 9 successfully meshes with the ring gear 8. After the pinion 9 successfully meshes with the ring gear 8, the variable reducer 6 is switched into the non-retarding mode. That is, as shown in FIG. 2, the starter characteristic is set to a high-torque low-speed characteristic for a time interval (t1 in FIG. 2) from initiation of energization of the solenoid SL1 until the pinion 9 successfully meshes with the ring gear 8. During cranking of the engine after the pinion 9 has successfully meshed with the ring gear 8, the starter characteristic is set to a low-torque high-speed characteristic.

When to switch the starter characteristic from the high-torque low-speed characteristic to the low-torque high-speed characteristic may be set by a timer circuit 31 as a timing controller configured to control when the starter-characteristic switching mechanism (6, 30) switches the starter characteristic (see FIG. 1). More specifically, a time interval (or an elapsed time) from the initiation of energization of the solenoid SL1 to when the pinion 9 successfully meshes with the ring gear 8 may be counted (by using a timer function of the a timer circuit 31) beforehand. The counted time interval may be set in the timer circuit 31. As shown in FIG. 1, the timer circuit 31 is activated in response to an ON-signal to the starter relay 2. Upon expiration of the time interval t1 (see FIGS. 2, 3), the motor actuator in the mode switcher 30 is energized.

Advantages

Figure 3:
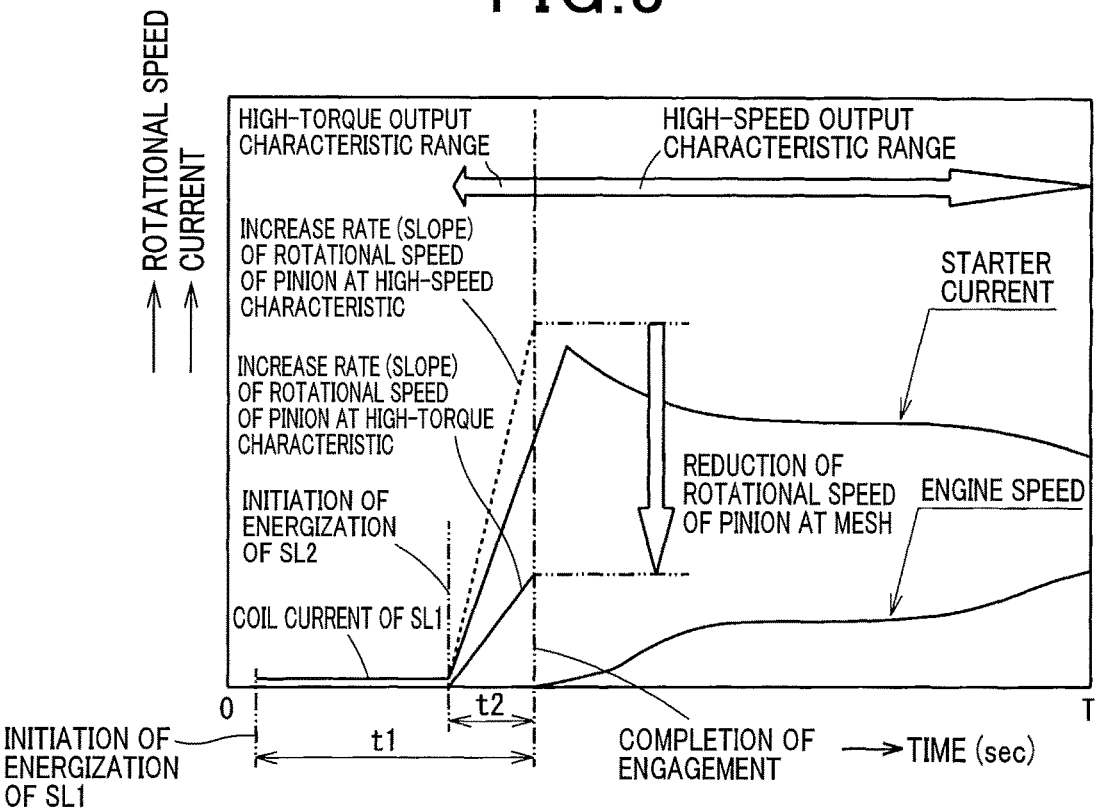
FIG. 3 is an enlarged diagram of a portion of FIG. 2.

At restarting of the engine from the idle stop, the starter characteristic is set to the high-torque low-speed characteristic from the initiation of energization of the solenoid SL1 at least until the pinion 9 successfully meshes with the ring gear 8, where the rotational speed of the pinion 9 is set lowest. As shown in FIG. 3, an increase rate of rotational speed of the pinion 9 is reduced as compared to that of the starter at the low-torque high-speed characteristic. That is, the rotational speed of the pinion 9 at mesh is reduced as compared to that of the starter at the low-torque high-speed characteristic. FIG. 3 is an expanded view of a waveform diagram for a time interval O-T along the time axis (abscissa) shown in FIG. 2. As described above, the pinion 9 is pushed toward the ring gear 8 by actuation of the solenoid SL1 and abuts the ring gear 8. When the pinion 9 and the ring gear 8 match in meshing phase during the rotation of the pinion 9, the pinion 9 successfully meshes with the ring gear 8. The rotational speed of the pinion 9 at mesh is a rotational speed of the pinion 9 at the moment when the pinion 9 successfully meshes with the ring gear.

In the engine starting apparatus of the first embodiment configured as above, the reduced rotational speed of the pinion at mesh can enhance the engagement reliability. There is thus no need to increase the load of the drive spring 32 (see FIG. 1) for pushing the pinion 9 toward the ring gear 8. Therefore, there is no need to increase the attractive force of the solenoid SL1. This can prevent degradation of installation property of the starter without increasing the dimensions of the starter.

In addition, after the pinion 9 has successfully meshed with the ring gear 8, the variable reducer 6 is switched into the non-retarding mode and the engine is then cranked at the low-torque high-speed characteristic. The cranking speed is thus increased. The increased cranking speed can lead to a reduced engine starting time. Particularly, in the case of the vehicle with the idle stop system or the automated stop and go system, an amount of time from the initiation of actuation of the starter (the initiation of energization of the solenoid SL1 in the present embodiment) until the engine restart can be reduced, which can contribute to enhancement of the comfort of a driver or other occupants of the vehicle.

With use of the timer circuit 31 to switch the operational mode of the variable reducer 6 (between the retarding mode and the non-retarding mode), when to switch the operational mode of the variable reducer 6 from the high-torque low-speed characteristic to the low-torque high-speed characteristic can be readily and properly controlled.

In addition, the starter 1 of the present embodiment uses the brushed DC motor, which allows the engine starting apparatus to be realized with lower cost as compared to when an alternating current (AC) motor is used that uses an inverter for controlling large current.

Other embodiments of the present invention will now be explained with reference to the accompanying drawings. Elements having the same functions as in the first embodiment are assigned the same numbers and will not be described again, for brevity.

Second Embodiment

The starter 1 of the first embodiment includes the variable reducer 6 for switching the starter characteristic between the two different characteristics, i.e., the low-torque high-speed characteristic and the high-torque low-speed characteristic. Alternatively, in the second embodiment, a plurality of such variable reducers 6 may be combined in series with each other, where the operational modes of the respective variable reducers 6 may be individually switched by the mode switcher 30. This allows the starter characteristic to be switched between at least three different characteristics, that is, the starter characteristic may be switched in at least three stages.

With this configuration, the output characteristic of the starter at mesh may be set to an output characteristic that is lower in torque than the highest-torque characteristic and higher in torque than the output characteristic at which the engine is cranked.

At such a high-torque low-speed characteristic, as in the first embodiment, the rotational speed of the pinion at mesh can be reduced, which can enhance the engagement reliability. However, a too high starting torque of the motor 5 may increase gear-end-face wear between the pinion and the ring gear, leading to reduced durability for maintaining the engagement reliability. To avoid a situation where the starting torque of the motor 5 becomes too high at mesh, in the second embodiment, the output characteristic of the starter may be set not to the highest-torque characteristic, but to an output characteristic lower in torque than the highest-torque characteristic, that is, a proper-torque characteristic, until the pinion 9 successfully meshes with the ring gear 8. This allows enhancing the engagement reliability by reducing the rotational speed of the pinion at mesh while minimizing an increase of gear-end-face wear to maintain the durability.

Modifications

In the first embodiment, the timer circuit 31 is used to switch the operational mode of the variable reducer 6 between the retarding mode and the non-retarding mode. Instead of using the timer circuit 31, the ECU 4 may be used to provide the same function as the timer circuit 31. In the first embodiment, the timer circuit 31 is configured to count the elapsed time t1 from the initiation of energization of the solenoid SL1 until the starter characteristic is switched from the high-torque low-speed characteristic to the low-torque high-speed characteristic, where the timer circuit 31 starts time-counting in response to the ON-signal to the starter relay 2. Alternatively, the timer circuit 31 may be configured to count an elapsed time from the initiation of energization of the solenoid SL2 until the starter characteristic is switched from the high-torque low-speed characteristic to the low-torque high-speed characteristic, where the timer circuit 31 may start time-counting in response to an ON-signal to the starter relay 3. That is, at time t2 after the initiation of the energization of the solenoid SL2 (see FIGS. 2, 3), the motor actuator of the mode switcher 30 may be energized.

In the first embodiment, the starter-characteristic switching mechanism is configured to switch the starter characteristic from the high-torque low-speed characteristic to the low-torque high-speed characteristic. In the second embodiment, the starter-characteristic switching mechanism is configured to switch the starter characteristic in at least three stages between the high-torque low-speed characteristic and the low-torque high-speed characteristic. Alternatively, the starter-characteristic switching mechanism may be configured to switch the starter characteristic not in the gradually variable manner as in the first and second embodiments, but in a continuously variable manner.

The electro-magnetic solenoid device 10 of the first embodiment is a tandem-solenoid device including the solenoid SL1 for pushing the pinion 9 toward the ring gear 8, and the solenoid SL2 for opening and closing the main contacts. Alternatively, instead of using such a tandem-solenoid device 10, a conventional electromagnetic switch may be used that is configured to use a single solenoid not only for pushing the pinion 9 toward the ring gear 8, but also for opening and closing the main contacts.

What is claimed is:

1. An apparatus for starting an engine, comprising:

an inertia-engagement-type starter configured to utilize an attractive force of a solenoid to push a pinion into an engaged position with a ring gear of the engine and then transfer a rotational force of the motor from the pinion to the ring gear to start the engine; a starter-characteristic switching mechanism configured to switch an output characteristic of the starter between a plurality of output characteristics including at least a low-torque high-speed characteristic and a high-torque low-speed characteristic, the output characteristic of the starter being referred to a starter characteristic; and a timing controller configured to control when the starter-characteristic switching mechanism switches the starter characteristic such that the starter characteristic is set to the high-torque low-speed characteristic from initiation of actuation of the starter at least until the pinion successfully meshes with the ring gear, and after the pinion has successfully meshed with the ring gear, the starter characteristic is switched from the high-torque low-speed characteristic to the low-torque high-speed characteristic at which the engine is cranked by the starter, wherein the high-torque low-speed characteristic to which the starter characteristic is set from the initiation of actuation of the starter at least until the pinion successfully meshes with the ring gear is a starter characteristic that is lowest in rotational speed of the pinion among the plurality of starter characteristics.

2. The apparatus of claim 1, wherein the starter-characteristic switching mechanism is configured to switch the starter characteristic between the plurality of starter characteristics in three or more stages or in a continuously variable manner, and the high-torque low-speed characteristic to which the starter characteristic is set from the initiation of actuation of the starter at least until the pinion successfully meshes with the ring gear is a starter characteristic that is lower in torque than a starter characteristic of highest torque among the plurality of starter characteristics.

3. The apparatus of claim 2, wherein the low-torque high-speed characteristic at which the engine is cranked by the starter is lower in torque than the high-torque low-speed characteristic to which the starter characteristic is set from the initiation of actuation of the starter at least until the pinion successfully meshes with the ring gear.

4. The apparatus of claim 1, wherein the timing controller comprises a timer function for counting an elapsed time from the initiation of actuation of the starter, and the timing controller is configured to control when the starter-characteristic switching mechanism switches the starter characteristic such that the starter characteristic is switched from the high-torque low-speed characteristic to the low-torque high-speed characteristic after the pinion has successfully meshed with the ring gear based on an elapsed time from the initiation of actuation of the starter counted by the timer function.

5. The apparatus of claim 4, wherein an elapsed time from the initiation of actuation of the starter to when the pinion successfully meshes with the ring gear counted by the timer function beforehand is pre-set in the timing controller, and the timing controller is configured to, when determining that an elapsed time from the initiation of actuation of the starter counted by the timer function has reached the pre-set elapsed time, trigger the starter-characteristic switching mechanism to switch the starter characteristic from the high-torque low-speed characteristic to the low-torque high-speed characteristic.

6. The apparatus of claim 1, wherein the motor is a brushed direct-current (DC) motor.

* * * * *